US008257137B2

(12) United States Patent
Liu

(10) Patent No.: US 8,257,137 B2
(45) Date of Patent: Sep. 4, 2012

(54) SIMULATED EYE FOR TOY

(75) Inventor: Bao-Shuai Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 477 days.

(21) Appl. No.: 12/580,261

(22) Filed: Oct. 16, 2009

(65) Prior Publication Data

US 2010/0151768 A1 Jun. 17, 2010

(30) Foreign Application Priority Data

Dec. 16, 2008 (CN) ..... 2008 1 0306284

(51) Int. Cl.
*A63H 3/38* (2006.01)

(52) U.S. Cl. ..... 446/392; 446/389

(58) Field of Classification Search ..... 446/389, 446/392

See application file for complete search history.

(56) References Cited

U.S. PATENT DOCUMENTS

| | | | | |
|---|---|---|---|---|
| 4,332,039 | A * | 6/1982 | LaFuente | 623/6.64 |
| 5,108,427 | A * | 4/1992 | Majercik et al. | 623/5.12 |
| 5,900,923 | A * | 5/1999 | Prendergast et al. | 351/221 |
| 6,139,577 | A * | 10/2000 | Schleipman et al. | 623/6.64 |
| 6,391,057 | B1 * | 5/2002 | Schleipman et al. | 623/6.64 |
| 6,776,683 | B1 * | 8/2004 | Lin | 446/392 |
| 7,485,025 | B2 * | 2/2009 | Schnuckle | 446/392 |
| 2004/0256920 | A1 * | 12/2004 | Gummin et al. | 310/15 |
| 2006/0113880 | A1 * | 6/2006 | Pei et al. | 310/800 |

FOREIGN PATENT DOCUMENTS

GB 1392431 A * 4/1975

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye capable of being changed between a normal and a dilated state. The simulated eye includes a simulated pupil, a circuit board, and at least one cylindrical portion. The circuit board is configured for supplying the at least one cylindrical portion with power. The at least one cylindrical portion is electrically connected to the circuit board. When the circuit board is operated to power on or power off the at least one cylindrical portion, the at least one cylindrical portion is driven to move toward or away from the eyeball, such that a size of a colored area consisting of the simulated pupil is changed between a normal state and a dilated state.

6 Claims, 7 Drawing Sheets

SIMULATED EYE FOR TOY

BACKGROUND

1. Technical Field

The disclosure relates to toys and, more particularly, to a simulated eye for a toy.

2. Description of Related Art

A typical toy replica of an eye has an eyelid that can open and close. Accordingly, other effects are needed to make the eyes more lifelike.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
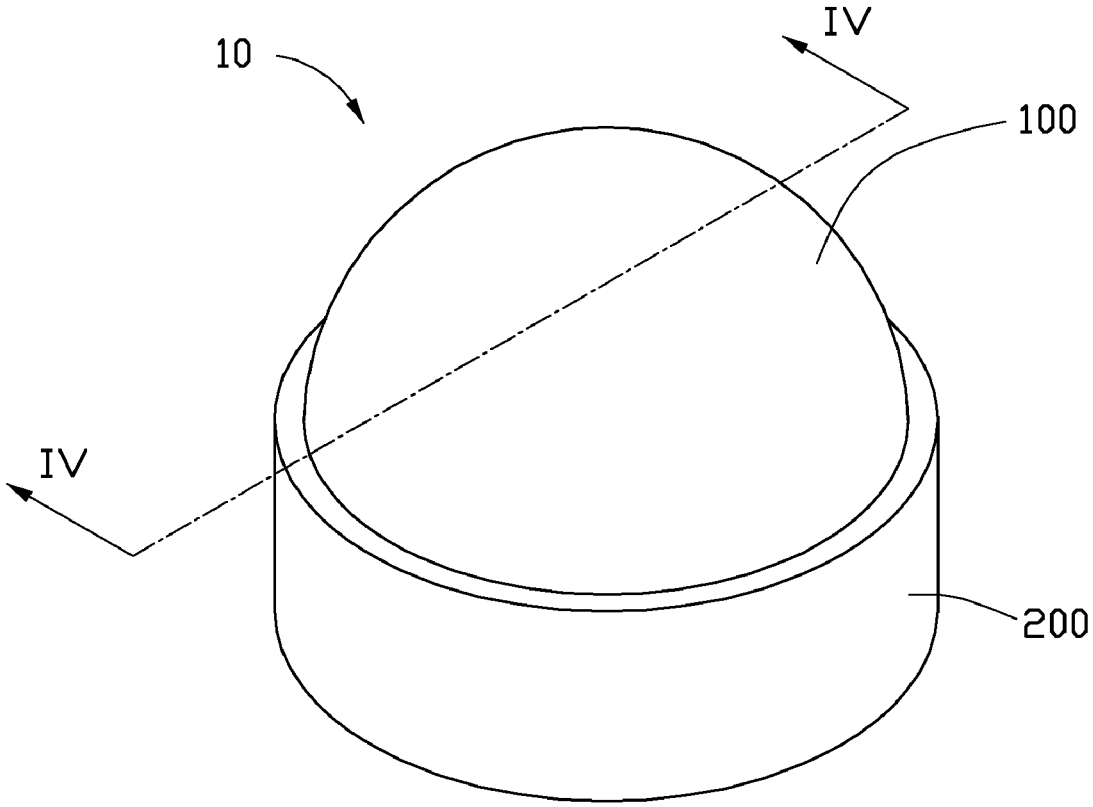
FIG. 1 is a perspective view of a simulated eye in accordance with one embodiment.

Referring to FIG. 1, a simulated eye 10 includes a semi-spherical eyeball 100 and a holder or an annular fixing member 200. The eyeball 100 is attached to the annular fixing member 200 and is exposed. The eyeball 100 is translucent and colored. In the embodiment, the color of the eyeball 100 is brown to simulate an iris. The simulated eye 10 may be fixed to a head of a toy via the annular fixing member 200.

Figure 2:
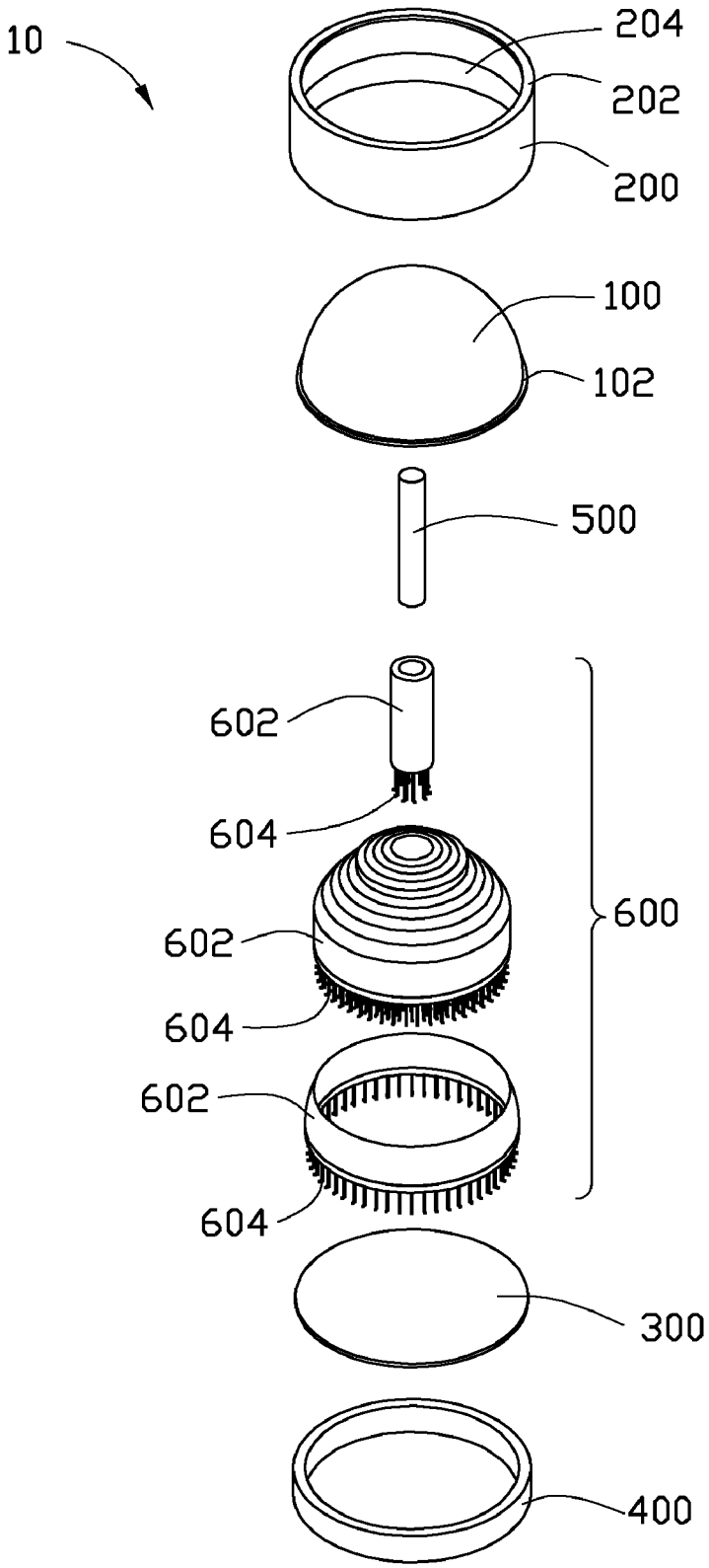
FIG. 2 is an exploded view of the simulated eye of FIG. 1, the simulated eye having a plurality of cylindrical portions.
Figure 3:
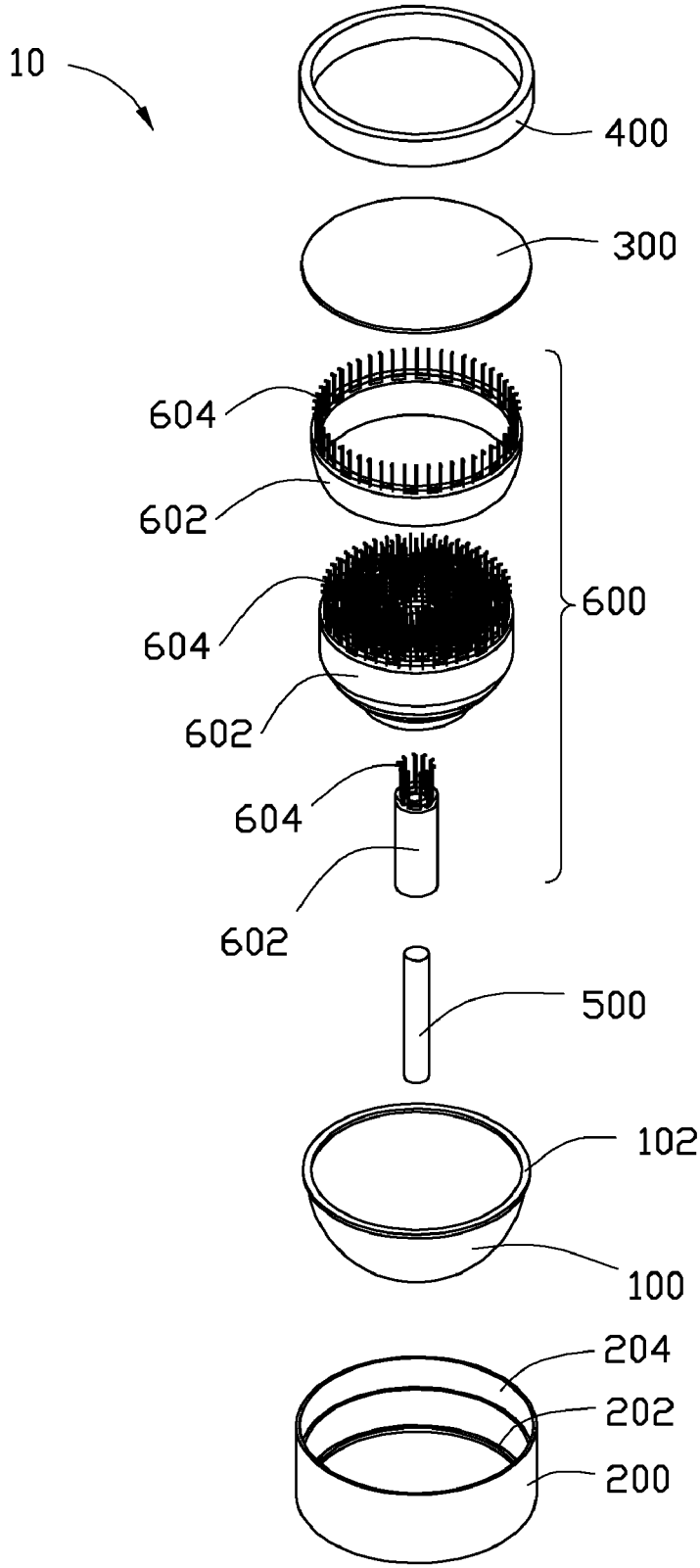
FIG. 3 is similar to FIG. 2, but viewed from another aspect.

Referring also to FIGS. 2-3, the simulated eye 10 further includes a circuit board 300, a ring 400, a post 500, and a plurality of cylindrical portions 600. The circuit board 300 is housed in the fixing member 200 via the ring 400. The post 500 is attached to an inner surface of the eyeball 100 and is visible thereat. The color of a distal end of the post 500 is darker than that of the translucent eyeball 100. In the embodiment, the color of the post 500 is black for simulating a pupil.

The cylindrical portions 600 and the post 500 are coaxial. The cylindrical portions 600 are sleeved on one another. The inner most cylindrical portion 600 is sleeved tight on the post 500 and is slidable relative to the post 500. All the cylindrical portions 600 are slidable relative to each other. A diameter of each of the cylindrical portions 600 decreases from the innermost cylindrical portion 600 to the outermost cylindrical portion 600. The cylindrical portions 600 are electrically connected to the circuit board 300 and face the eyeball 100. By operationally controlling the cylindrical portions 600 to move toward or away the eyeball 100 via the circuit board 300, the simulated eye 10 is changeable between a normal state and a dilated sate.

A flange portion 102 protrudes form a rim of the eyeball 100 and extends in a direction opposite to a center of the eyeball 100. A protrusion rim 202 protrudes inwardly from an end of the fixing member 200. A step portion 204 is formed in an inner surface of the fixing member 200. The diameter of the step portion 204 is slightly larger than that of the circuit board 300. It should be noted that in assembly, the eyeball 100 is attached to the fixing member 200 via the flange portion 102 engaging with the protrusion rim 202, and the circuit board 300 is fixed to the fixing member 200 via the ring 400 engaging with the step portion 204.

Figure 4:
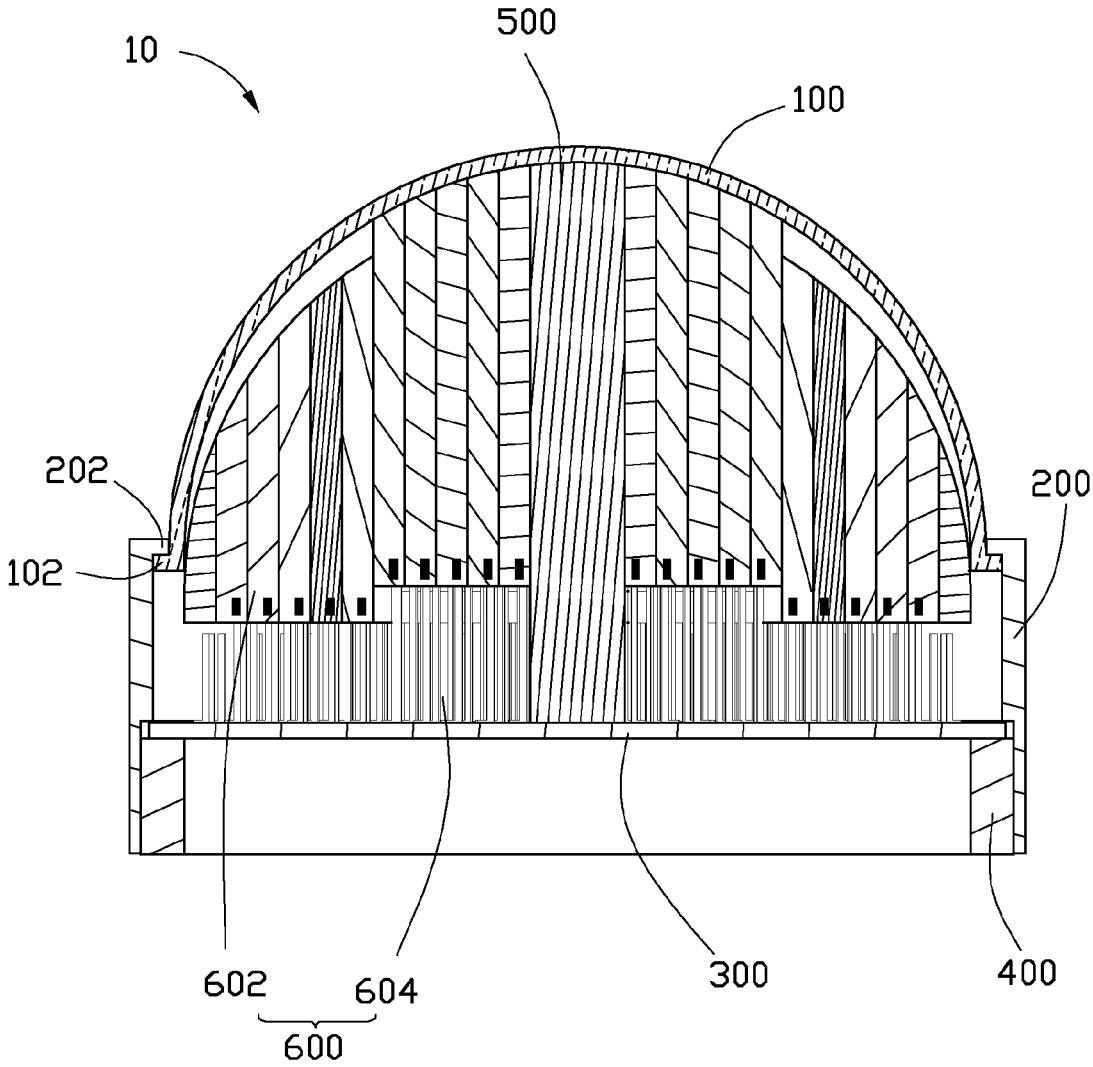
FIG. 4 is a cross-sectional view take along line IV-IV of FIG. 1 while the simulated eye is in a dilated state.
Figure 5:
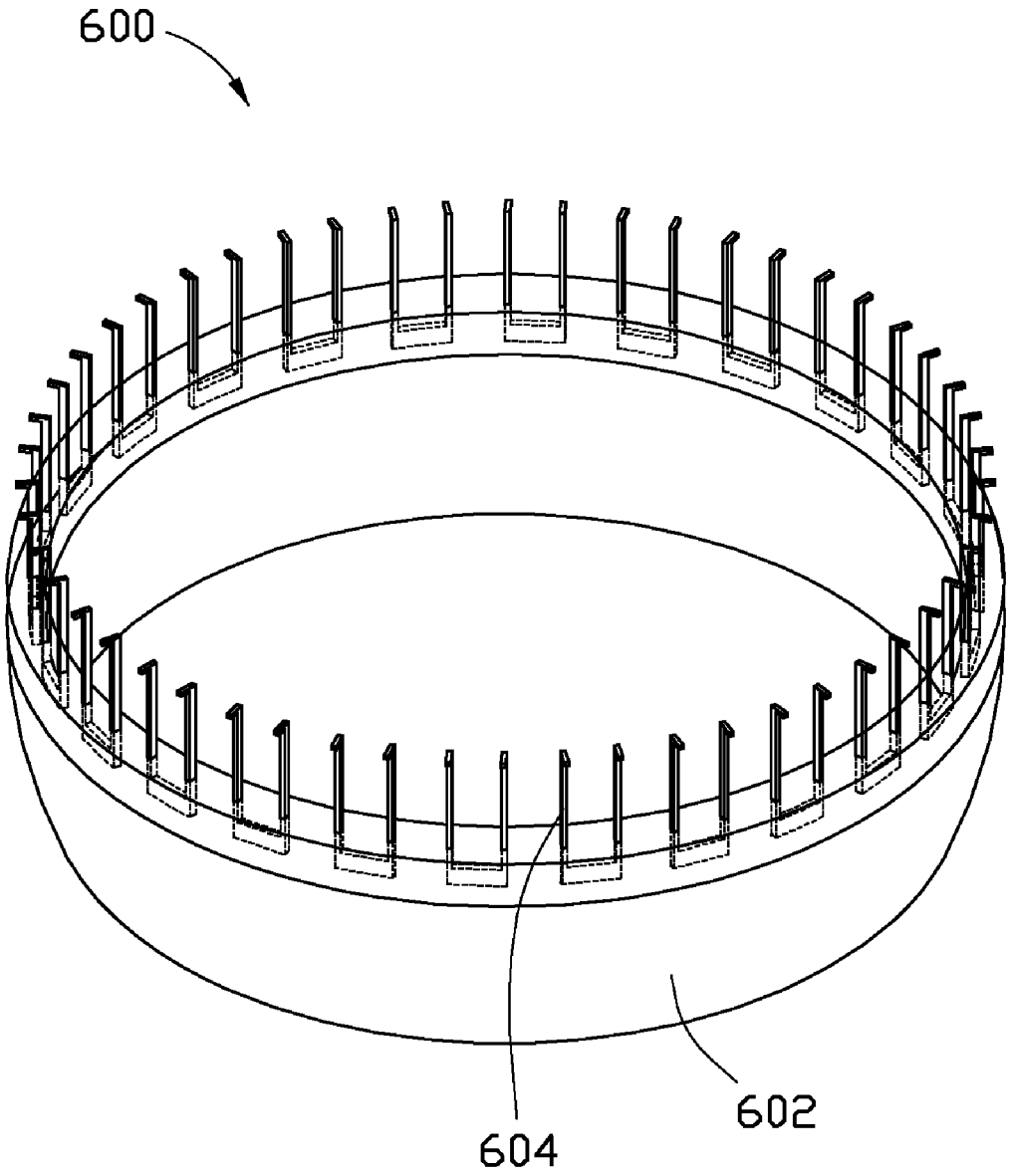
FIG. 5 is a perspective view of a cylindrical portion of FIGS. 2 and 3.

Referring also to FIGS. 4-5, each cylindrical portion 600 includes a sleeve 602 and a plurality of driving members 604. The length of the sleeves 602 decreases from the inner most sleeve. It should be noted that after assembly, the sleeves 602 form a substantially semispherical surface facing the eyeball 100. The sleeves 602 face the eyeball 100. The color of the sleeves 602 is substantially similar to that of the post 500. The sleeves 602 are visible at the eyeball 100 only when a distance between the eyeball 100 and the sleeves 602 is less than a predetermined value (for example, 2 mm); otherwise, the sleeves 602 are not visible. The driving members 604 are attached to the sleeve 602 and are arranged symmetrically. The driving members 604 are further electrically connected to the electric board 300. The driving members 604 expand longitudinally when heated. When the driving members 604 are supplied with electrical power via the circuit board 300 the electrical power is converted into heat in the driving members 604 and the driving members 604 expand longitudinally. When the voltage to the driving members 604 is removed, the driving members 604 shrink to their original size. In the embodiment, the driving members 600 are substantially U-shaped memory alloys (also named as shape memory alloy, smart metal, muscle wire, or smart alloy).

After assembly, the post 500 is visible at the eyeball 100 for simulating a pupil. The cylindrical portions 600 are slidably coupled to the post 500 and are further electrically connected to the circuit board 300. The cylindrical portions 600 are located in a predetermined position, such that the cylindrical portions 600 are not visible at the eyeball 100. In the embodiment, the distance between the eyeball 100 and cylindrical portions 600 is slightly larger than 2 mm.

Figure 6:
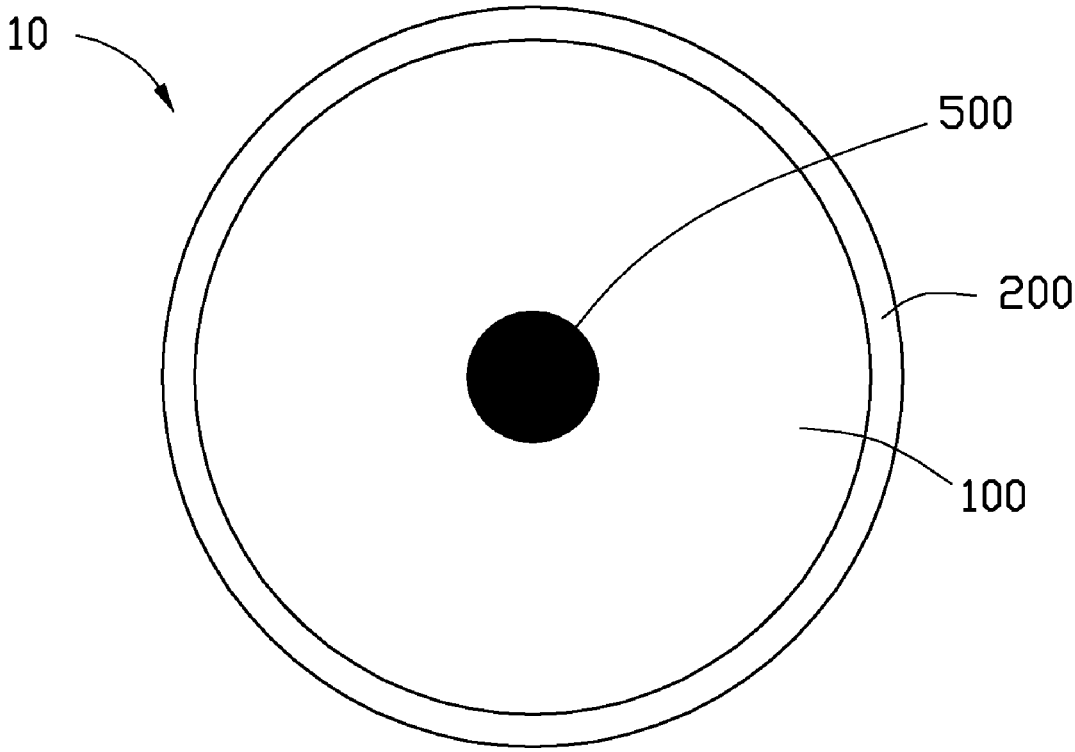
FIG. 6 is a perspective view of the simulated eye of FIG. 1 in a normal state.

Referring to FIG. 6, when the cylindrical portions 600 are not supplied with power, the driving members are in its original shape, that is, not expanded, and the distance between the eyeball 100 and the sleeves 602 are larger than the predetermined value 2 mm. In this state, only the color of the post 500 is visible, the color of the cylindrical portions 600 is not visible, and the simulated eye 10 is said to be in a normal state.

Figure 7:
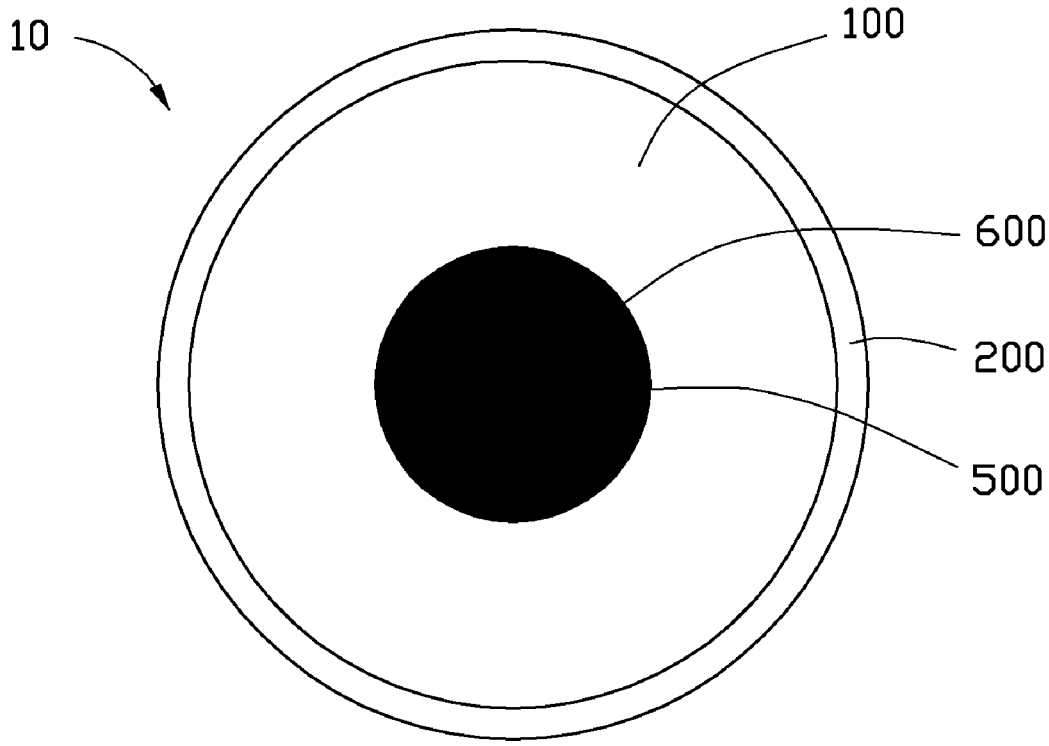
FIG. 7 is also a perspective view of the simulated eye of FIG. 1 in a dilated state.

Referring to FIG. 7, when the driving members 604 are supplied with power, the driving members 604 expand longitudinally to push the sleeves 602 toward the eyeball 100, and the color of the sleeves 602 is visible at the eyeball 100. As the color of the sleeves 602 is substantially similar to that of the post 500, the size of the colored area of the pupil expands, and the pupil 500 appears dilated. Therefore, by supplying the driving members 604 with power, the simulated eye 10 changes from the normal state to a dilated state.

When the driving members 604 are powered off, the driving members 604 shrink to its original shape, and the sleeves 602 are driven to move backward the eyeball 100, thus, the size of colored area returns to an original size. As a result, the simulated eye 10 returns to the normal state.

Furthermore, the circuit board 300 can be electrically connected to a processing system (not shown), a user can operate the processing system to control the circuit board 300 to selectively supply power to the driving members 604 in a sequence from the inner most cylinder portion to the outermost cylinder portion. Accordingly, when the driving members 604 are selectively powered in the sequence, the size of the colored area gradually enlarges. As a result, the simulated eye 10 appears to dilate gradually. In reverse, the simulated eye 10 is contracted gradually when the driving members 604 are selectively powered off in reverse sequence, thus, the colored area appearing in the eyeball 100 contracts gradually. Referring to FIG. 4, only part of the driving members 604 are supplied with power, thus, only part of the cylindrical portion 600 are visible at the eyeball 100.

Therefore, by operationally powering on and down the driving members 604 to change the size of the colored area appearing in the eyeball 100, the simulated eye 10 is changeable between a normal state and a dilated state.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

a semispherical eyeball comprising a translucent portion;

a simulated pupil visible at the translucent portion;

a circuit board for supplying power; and at least one cylindrical portion, wherein the at least one cylindrical portion comprises at least one sleeve and a plurality of driving members attached to one side of the at least one sleeve, and the plurality of driving members are U-shaped memory alloys each comprising two distal ends connected to the circuit board for being powered on or off by the circuit board;

wherein when the plurality of driving members are powered on via the circuit board, the plurality of driving members expand longitudinally and the at least one sleeve moves toward the eyeball and is visible at the translucent portion; and wherein when the plurality of driving members are powered off, the plurality of driving members return to their original sizes and the at least one sleeve moves away from the eyeball and is not visible at the translucent portion.

2. The simulated eye of claim 1, wherein a color of the simulated pupil is darker than that of the eyeball.

3. The simulated eye of claim 1, wherein a color of the at least one cylindrical portion is similar to that of the simulated pupil.

4. The simulated eye of claim 1, wherein the at least one cylindrical portion and the simulated pupil are coaxial.

5. The simulated eye of claim 1, wherein the at least one sleeve is slidable relative to the simulated pupil.

6. The simulated eye of claim 1, further comprising a fixing member, the eyeball attached to the fixing member and exposed thereat, and the circuit board is housed in the fixing member.

* * * * *